US005562484A

United States Patent [19]

Mlynarz et al.

[11] Patent Number: 5,562,484

[45] Date of Patent: Oct. 8, 1996

[54] ELECTRICAL TERMINAL WASHER

[75] Inventors: Richard Mlynarz, Seine; Jacques Joron, Paris, both of France

[73] Assignee: Delphi France Automotive Systems, Paris, France

[21] Appl. No.: 397,525

[22] Filed: Mar. 2, 1995

[30] Foreign Application Priority Data

Mar. 10, 1994 [GB] United Kingdom ..... 9404611

[51] Int. Cl.[6] ..... H01R 13/58

[52] U.S. Cl. ..... 439/474; 411/373

[58] Field of Search ..... 439/92, 108, 433, 439/434, 474, 801, 808, 809, 813; 411/429, 373, 374, 371, 910, 546, 547.

[56] References Cited

U.S. PATENT DOCUMENTS 4,502,743 3/1985 Ziegler ..... 339/14 L

FOREIGN PATENT DOCUMENTS

0301326A2 2/1989 European Pat. Off. .

91/17588 11/1991 Germany .

0632048 11/1949 United Kingdom .

2012122 7/1979 United Kingdom .

*Primary Examiner*—Austin P. Bradley

*Assistant Examiner*—Yong Kim

*Attorney, Agent, or Firm*—Vincent A. Cichosz

[57] ABSTRACT

An electrical terminal washer (40) includes a substantially flat contact wall (42) having an aperture (44) therein and four curved wall portions (48–54) depending from the contact wall (42) and forming an internal cavity (58) within the washer (40). Two opposing wall portions (48,52) have curved engagement ribs (28) disposed within the internal cavity. A stud (10) includes a connection end (12) which extends through the aperture (44) in the washer (40) and a hexagonal tightening portion (22) receivable within the internal cavity. The length of each rib (28) is greater than the length of each surface of the tightening portion (22) to enable the washer (40) to rotate on the stud (10) and to avoid the need for indexing the washer (40) on the stud (10) during assembly.

9 Claims, 5 Drawing Sheets

ELECTRICAL TERMINAL WASHER

The present invention relates to an electrical terminal and to an electrical terminal washer.

BACKGROUND OF THE INVENTION

In alternators and generators used, for example, in automotive applications, it is common to provide a stud which extends out of the casing of the alternator or generator and which is employed to couple a wiring harness of the vehicle to the alternator or generator circuit board. The stud is typically threaded at both ends, one of which ends is bolted to the circuit board, while the other end receives a bolt or nut used in securing an eyelet terminal of a harness wire to the stud. In order to facilitate attachment of the stud to the circuit board, the portion intermediate its two threaded ends has a hexagonal shape for engagement by a wrench or spanner. The hexagonal portion includes a shoulder which acts as a stop to limit the travel of the harness bolt on the stud.

It has been found that with this type of stud, it is possible for the harness bolt to be over-torqued during tightening and untightening, leading to possible damage to the circuit board and/or to the possibility of unscrewing the stud from the circuit board on attempted removal of the harness bolt.

The present invention seeks to overcome this problem.

An electrical terminal in accordance with the present invention comprises a washer including a substantially flat contact wall with an aperture therethrough and at least two wall portions depending from the contact wall, each wall portion having an inwardly directed engagement surface lying on an arc of predetermined circumferentially length; and a stud including a connection end adapted to extend through the aperture, and a polygonal tightening portion receivable between the wall portions and comprising a plurality of substantially identical flat surfaces of predetermined length, the length of each flat surface being less than the length of each engagement surface, and the engagement surfaces resiliently engaging the polygonal tightening portion.

The shape of the washer ensures that it can rotate on the stud, thereby providing protection against over-torquing of a harness bolt. Moreover, the engagement of the surfaces acts to retain the washer on the stud, thereby facilitating assembly of the generator or alternator.

Preferably, the polygonal portion of the stud is substantially hexagonal. This shape matches conventional spanners and wrenches.

According to another aspect of the present invention, there is provided an electrical terminal washer for an electrical terminal as herein described.

DESCRIPTION OF THE PREFERRED EMBODIMENT

The present invention will now be described, by way of example only, with reference to the accompanying drawings, in which.

Figure 1:
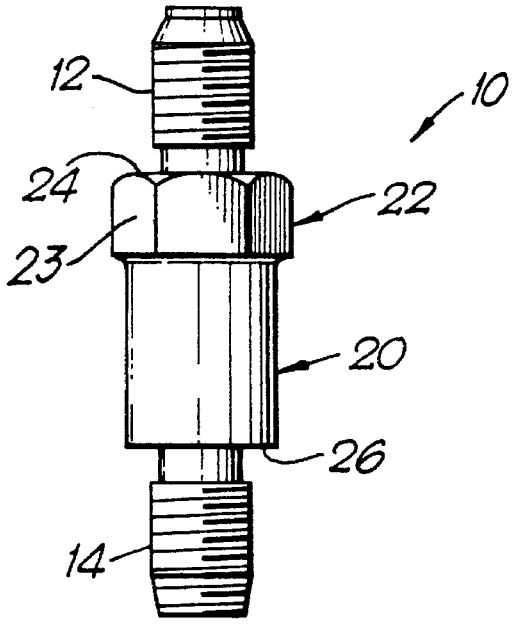
FIG. 1 is a side elevational view of an example of stud.
Figure 2:
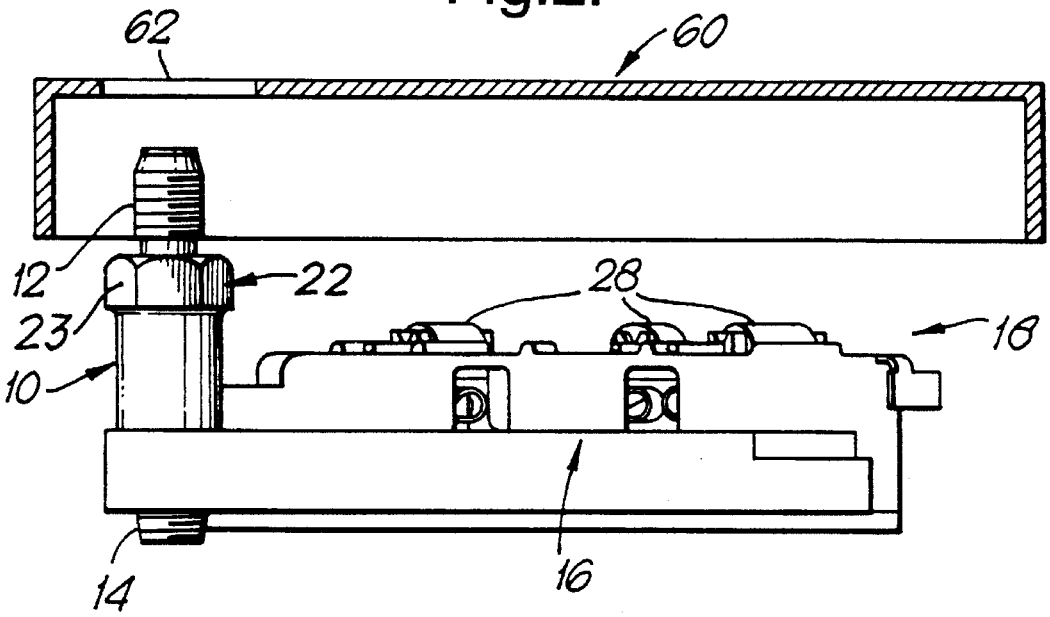
FIG. 2 is an exploded side elevational view of an example of circuit board of a generator including the stud of FIG. 1.

Referring to FIGS. 1 and 2, an example of stud 10 for use in an alternator or generator includes a threaded harness end 12 onto which a wiring harness bolt or nut (not shown) can be screwed. The stud 10 also includes a threaded board end 14 which in use is coupled to a circuit board 16 of, for example, the type shown in FIG. 2. The stud 10 is made of or coated with an electrically conductive material such that it can be used as an electrical coupling between the wiring harness and alternator circuit 18, in this example a voltage rectifier. Such an electrical connection can be made, for example, by means of a wire soldered to the stud 10 and circuit 18.

The stud 10 includes a generally cylindrical body portion 20 intermediate the threaded ends 12,14 and having at an end thereof a tightening portion 22 which, in a preferred embodiment, is hexagonal in axial cross-section. The tightening portion 22 is defined by substantially flat identical surfaces 23 which can be engaged by a wrench or spanner so as to tighten the stud 10 onto a nut (not shown) retained in non-rotating manner on the circuit board 16. The tightening portion 22 includes a shoulder 24 adjacent the harness end 12 of the stud 10 which acts as a stop for limiting the travel of the harness bolt on the stud 10.

The body portion 20 of the stud 10 includes a shoulder 26 which rests on the circuit board 16 such that the end 14 passes through a hole in the circuit board 16 and receives a nut (not shown) which is retained in a non-rotating manner relative to the circuit board 16.

Figure 3:
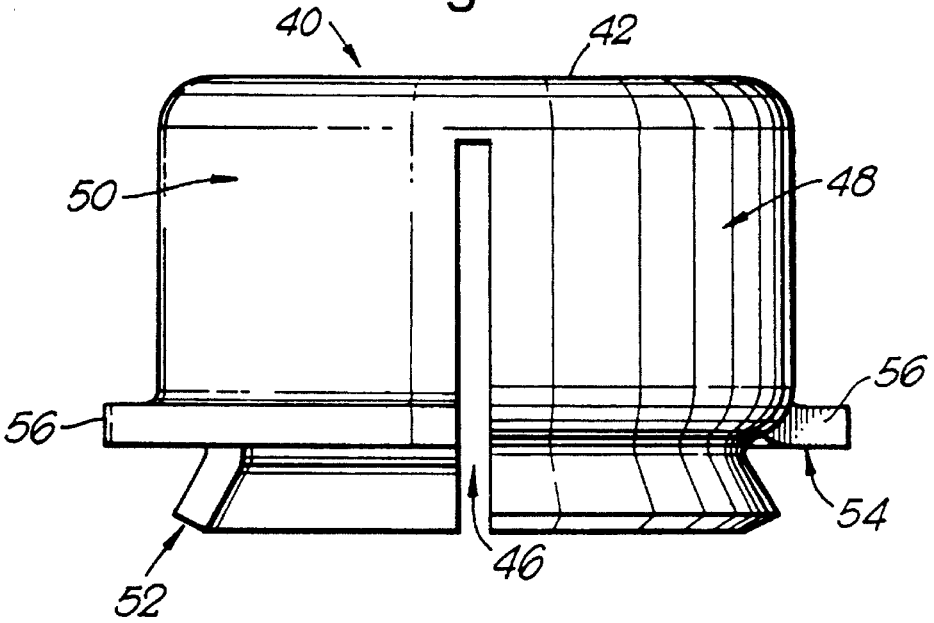
FIG. 3 is a front elevational view of a first embodiment of washer in accordance with the present invention.
Figure 4:
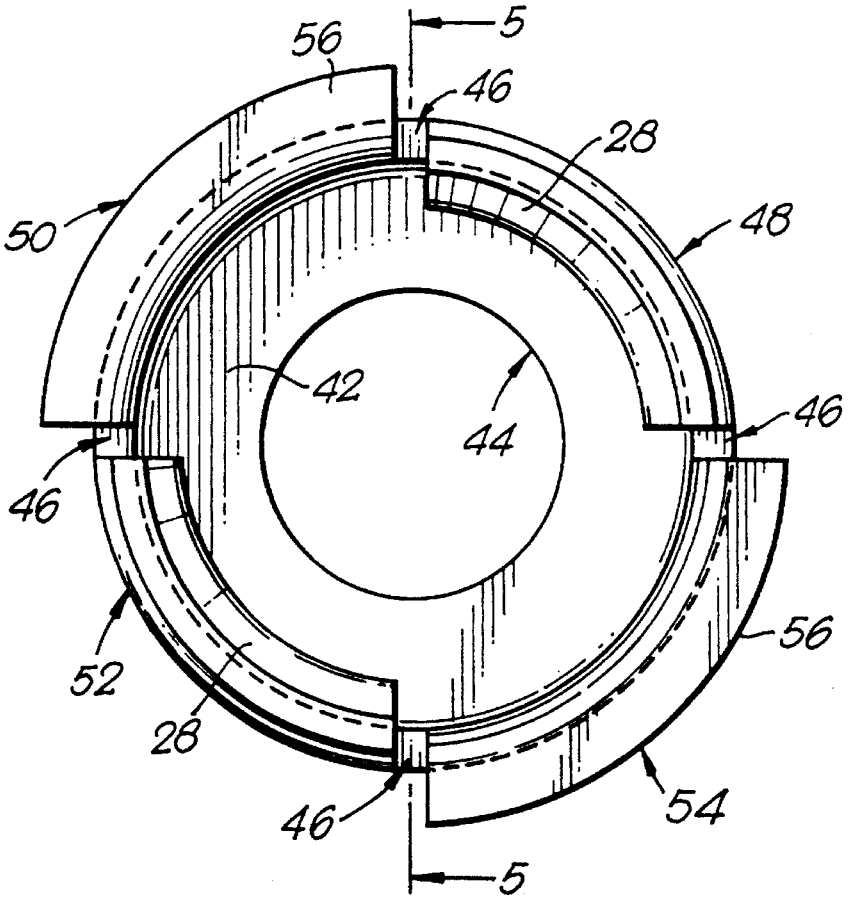
FIG. 4 is a bottom view of the washer of FIG. 3.
Figure 5:
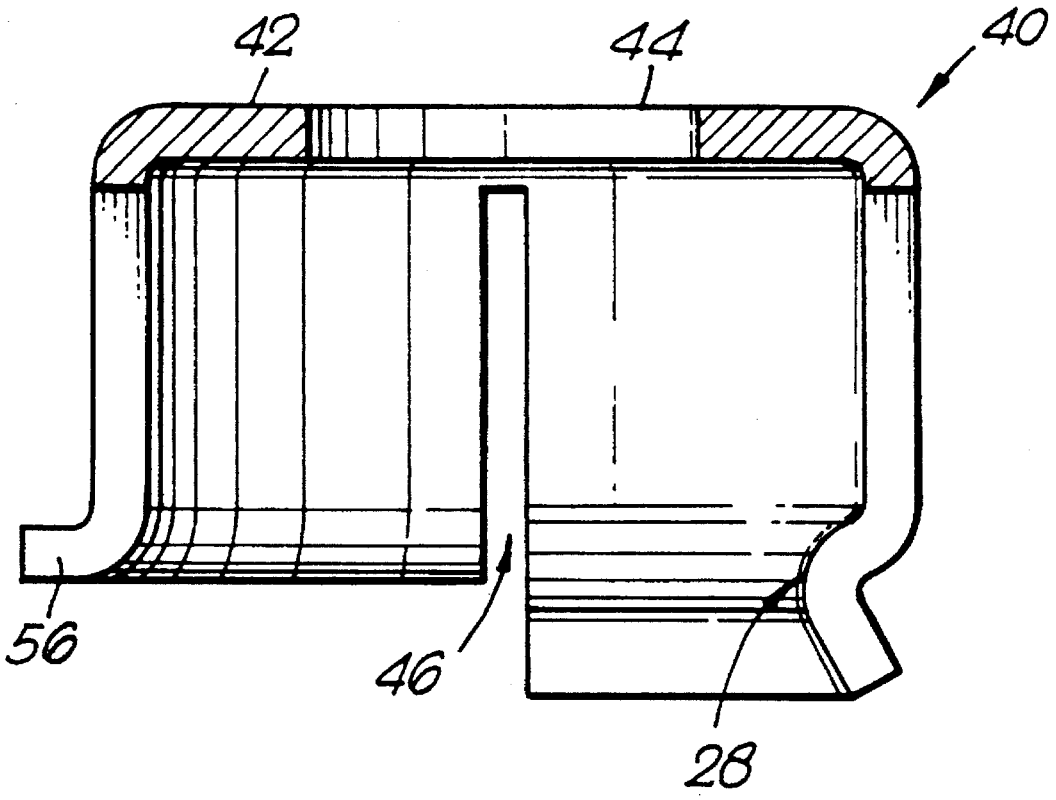
FIG. 5 is a cross-sectional view of the stud of FIG. 3 taken along line 5—5 of FIG. 4

The circuit board shown in FIG. 2 in use fits within a plastics case 60, which includes an aperture 62 through which at least the harness end 12 of the stud 10 extends, such that the harness bolt can be coupled to the stud 10 from the outside of the case 60. In order to substantially ensure that the harness bolt is not over-torqued on the stud 10, a washer of the type shown in FIGS. 3 to 5 is provided. The washer 40 is designed to fit over the hexagonal portion 22 and to be held within the case 60.

Referring to FIGS. 3 to 5, the embodiment of washer 40 shown is substantially cup-shaped and includes a disc-shaped contact wall 42 which has a substantially circular central aperture 44 therein. A depending wall extending from perimeter of the contact wall 42 has four slots 46 formed therein which are substantially equidistant from one another and which extend substantially along the axial direction A of the washer 40 so as to form four wall portions 48–54.

The free ends 55 of the two opposing wall portions 50,54 are bent outwardly so as to form two flanges 56 which are substantially parallel to the contact wall 42.

The flanges 56 have a width greater than the distance between the contact walls 42 or depending wall portions 48–52 and the edge of the aperture 62 in the case 60. That is, the maximum diameter of the washer 40 is greater than the maximum diameter of the aperture 62. Thus, when the washer 40 is fitted to the stud 10 within the case 60, the washer 40 and stud 10 cannot be removed from the case 60 because of abutment of the flanges 56 on the inner surface of the case wall. Thus, the stud 10 is retained within the case 60 even if the stud becomes disconnected from the circuit board 16, for example during release of the harness bolt.

Referring in particular to FIG. 5, proximate the free end 57 of each of the two opposing wall portions 48 and 52 there is formed an engagement surface defined by a rib 28 extending inwardly into the cavity 58 within the washer 40. The free ends 57 of the opposing wall portions 48,52 taper or flare outwardly from the cavity 58 to assist in pushing the free ends 57 of the wall portions 48,52 away from one another during fitting of the washer 40 on the stud 10.

Each of the wall portions 48–54 extends over an arc of approximately 90 degrees measured from the axis A of the washer 40, and in the embodiment shown, the ribs 28 all extend over an arc of approximately 90 degrees.

Figure 6:
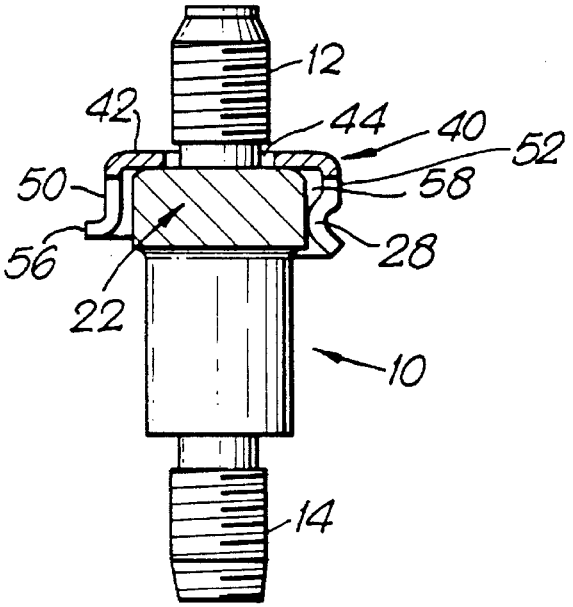
FIG. 6 is a cross-sectional view of an electrical terminal in accordance with the present invention comprising the stud of FIG. 1 and the washer of FIGS. 3 to 5.

The washer 40 fits over the stud 10 (FIG. 6) such that the harness end 12 extends through the aperture 44, while the depending wall portions 48–54 extend over the hexagonal portion 22 of the stud 10. The washer 40 is of a size relative to the stud 10 which ensures that the ribs 28 contact the surfaces 23 of the hexagonal portion 22 with sufficient force to grip and hold the washer 40 on the stud 10 so that it does not fall off accidentally during assembly but which is sufficiently low to ensure that the washer 40 can rotate on the stud 10 about axis A.

Since the ribs 28 extend over an arc of approximately 90 degrees, while each surface 23 of the hexagonal portion 22 of the stud 10 extends over only 60 degrees of the stud 10, each rib 28 will always interfere with at least one corner between the surfaces 23 because the circumferential length of each rib 28 is greater than the length of each surface 23, when measured from corner to corner. Thus, there is no need during assembly to index the washer 40 relative to the stud 10.

The circuit 18 is coupled to the vehicle wiring harness by placing on the harness end 12 of the stud 10 an eyelet, of conventional form, to which is soldered or otherwise secured a wire of the harness. A bolt is then threaded onto the harness end 12 and tightened to secure the eyelet to the stud 10. The contact wall 42 of the washer 40 is positioned between the shoulder 24 on the stud 10 and the eyelet. The washer 40, by virtue of its being able to rotate on the stud 10, provides an anti-turn effect which prevents the bolt being over-torqued on the harness end 12.

For a stud having a portion 22 of a shape other than the hexagonal shape shown, the washer 40 may be formed of a different number of wall portions 48–54 than the number shown and described above. Moreover, in some embodiments, retaining flanges could be provided on the wall portions 48,52 which include the ribs 28, in addition to or in replacement of the flanges 56 of the wall portions 50,54.

Figure 7:
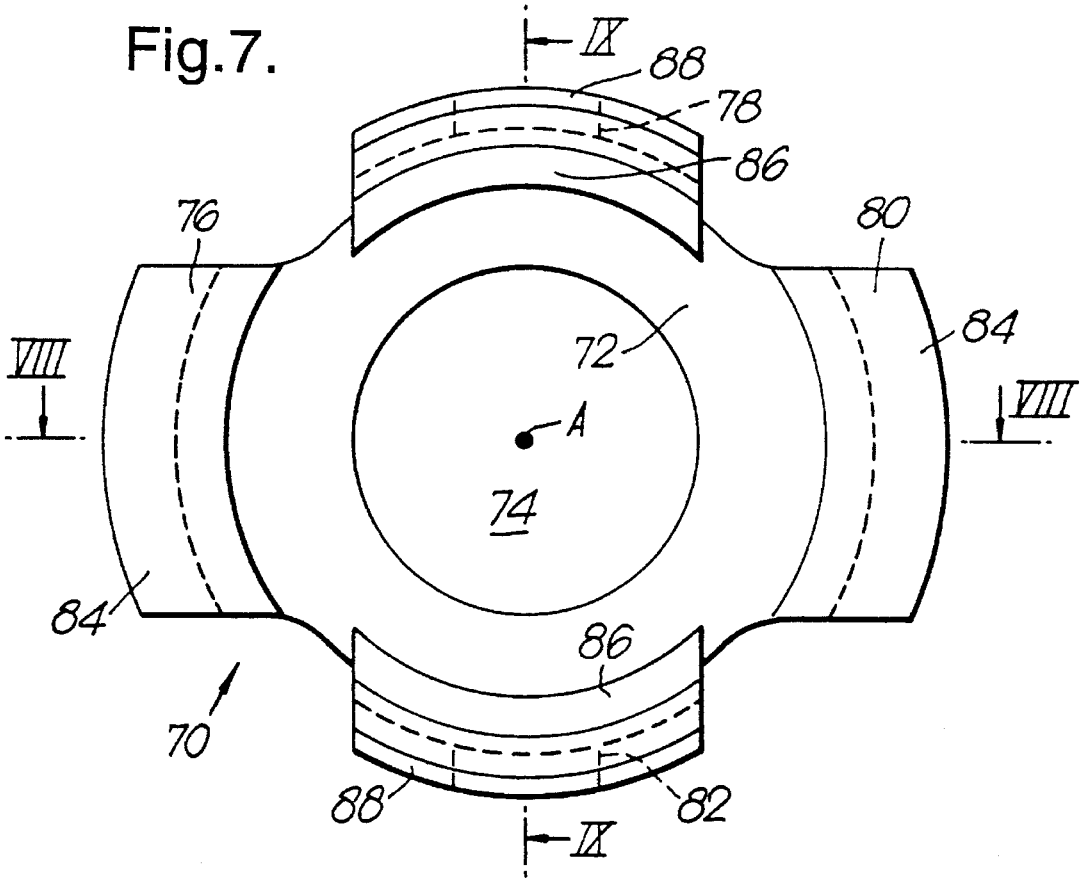
FIG. 7 is a bottom view of a second embodiment of washer in accordance with the present invention usable with the stud of FIG. 1.
Figure 8:
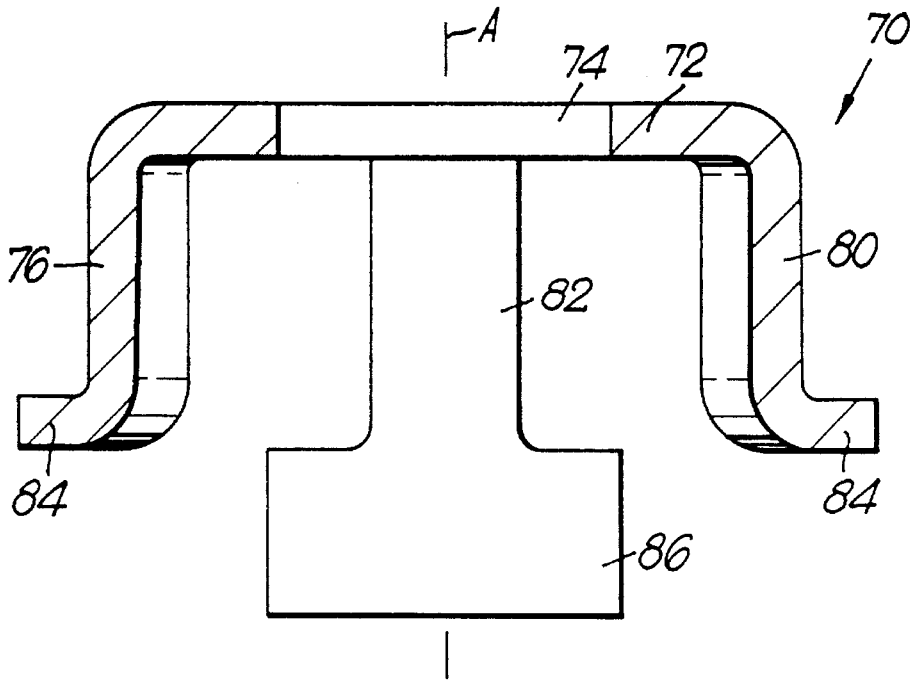
FIG. 8 is a cross-sectional view on the line VIII—VIII of FIG. 7.
Figure 9:
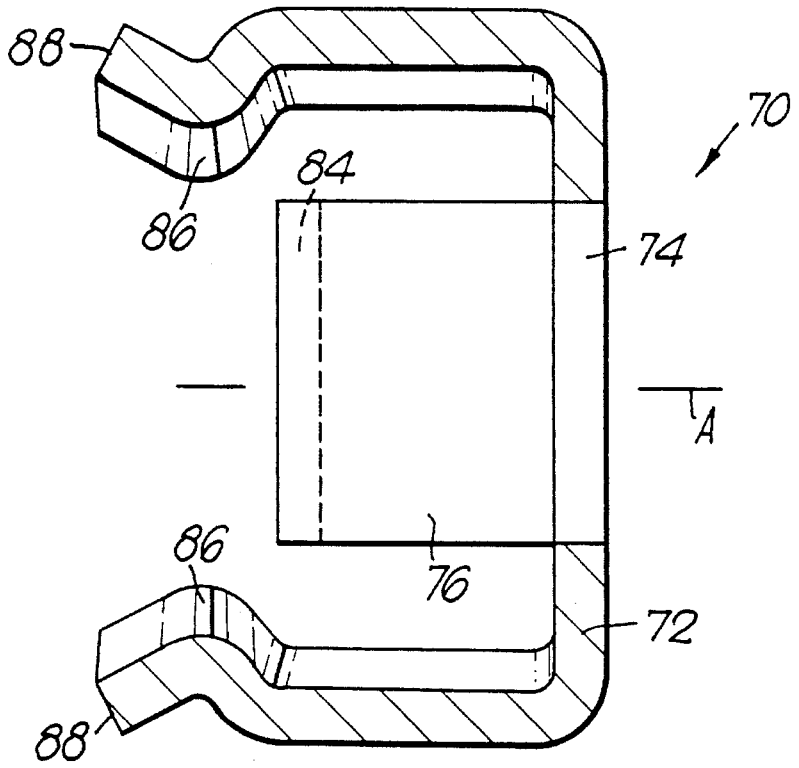
FIG. 9 is a cross-sectional view on the line IX—IX of FIG. 7.

The alternative embodiment of washer 70 shown in FIGS. 7 to 9 also has a contact wall 72, aperture 74 and wall portions 76–82, two of which 76,80 have outwardly directed flanges 84, and the other two 78,82 having inwardly directed ribs 86 and flared free ends 88, as the washer 40 in FIGS. 3 to 5. However, in this case, the ribs 86 extend over an arc of approximately 85 degrees relative to axis A, and the associated wall portions 78,82 have a smaller arc length than the arc length of the ribs. This arrangement provides for increased flexibility of the wall portions 76,82 (in comparison to the wall portions 48,52 of the washer 40) for easier insertion of the washer 70 on the hexagonal portion 22 of the stud 10.

The washers 40,70 are preferably stamped from sheet steel.

The outwardly directed flanges 56;84 on the wall portions 50,54;76,80 may be omitted. In this case, additional inwardly directed ribs may be formed on these wall portions to provide additional grip on the hexagonal portion 22 of the stud 10.

The embodiments of the invention in which an exclusive property or privilege is claimed are defined as follows:

1. An electrical terminal comprising a washer including a substantially flat contact wall with an aperture therethrough and at least two wall portions depending from the contact wall, each wall portion having an inwardly directed engagement surface lying on an arc of predetermined circumferentially length; and a stud including a connection end adapted to extend through the aperture, and a polygonal tightening portion receivable between the wall portions and comprising a plurality of substantially identical flat surfaces of predetermined length, the length of each flat surface being less than the length of each engagement surface, and the engagement surfaces resiliently engaging the polygonal tightening portion.

2. An electrical terminal as claimed in claim 1, wherein the polygonal tightening portion of the stud is substantially hexagonal.

3. An electrical terminal as claimed in claim 1, wherein each engagement surface of each wall portion of the washer extends over an arc of substantially between 65 degrees and 90 degrees.

4. An electrical terminal as claimed in claim 1, wherein each engagement surface of each wall portion of the washer is defined by a rib formed in the wall portion.

5. An electrical terminal as claimed in claim 1, wherein each wall portion of the washer has a free end and each engagement surface is positioned proximate the free end.

6. An electrical terminal as claimed in claim 5, wherein the free end of each wall portion is flared outwardly.

7. An electrical terminal as claimed in claim 1, comprising two wall portions which are diametrically opposed.

8. An electrical terminal as claimed in claim 7, further comprising at least one additional wall portion depending from the contact wall of the washer, the additional wall portion having an outwardly directed flange extending substantially parallel to the contact wall.

9. An electrical terminal as claimed in claim 8, comprising two additional wall portions, the additional wall portions being diametrically opposed.

* * * * *